US006718849B2

(12) United States Patent
Haas

(10) Patent No.: US 6,718,849 B2
(45) Date of Patent: Apr. 13, 2004

(54) CLAMPING DEVICE FOR MANUALLY GUIDED ELECTRIC TOOLS

(75) Inventor: Günter Haas, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 10 days.

(21) Appl. No.: 09/928,772

(22) Filed: Aug. 13, 2001

(65) Prior Publication Data

US 2002/0020955 A1 Feb. 21, 2002

(30) Foreign Application Priority Data

Aug. 17, 2000 (DE) ..... 100 40 326

(51) Int. Cl.[7] ..... B25B 13/00; B25B 13/02
(52) U.S. Cl. ..... 81/55; 81/125
(58) Field of Search ..... 81/125, 55; D8/18, D8/21, 33, 20, 22, 23–25, 27, 28

(56) References Cited

U.S. PATENT DOCUMENTS

| | | | | | |
|---|---|---|---|---|---|
| 33,899 | A | * | 12/1861 | Morrill | 81/125 |
| 221,299 | A | * | 11/1879 | Gray | 411/144 |
| 349,581 | A | * | 9/1886 | Getman | 81/125 |
| 651,574 | A | * | 6/1900 | Meredith | 81/98 |
| 770,407 | A | * | 9/1904 | Ware | 81/125 |
| 995,211 | A | * | 6/1911 | Allen | 81/125 |
| 1,170,138 | A | * | 2/1916 | Bohne et al. | 81/125 |
| 1,732,804 | A | * | 10/1929 | Chicoine et al. | 294/15 |
| 1,913,535 | A | * | 6/1933 | Cressey | 81/3.44 |
| 2,072,463 | A | * | 3/1937 | Mims | 81/125 |
| D141,357 | S | * | 5/1945 | Brintnall | D8/23 |
| D143,898 | S | * | 2/1946 | Brintnall | D8/23 |
| 2,496,762 | A | * | 2/1950 | Weyrauch | 81/57.43 |
| 2,854,876 | A | * | 10/1958 | Green | 269/6 |
| 3,354,757 | A | * | 11/1967 | Grimm et al. | 81/176.1 |
| 3,511,118 | A | * | 5/1970 | Mitchell | 81/119 |
| 3,885,479 | A | * | 5/1975 | Ono | 81/3.43 |
| D238,999 | S | * | 3/1976 | Numbers | D8/17 |
| D241,604 | S | * | 9/1976 | Ward | D8/22 |
| D259,233 | S | * | 5/1981 | Dobias | D8/21 |
| D263,274 | S | * | 3/1982 | Hastings | D8/18 |
| D271,274 | S | * | 11/1983 | Tasato | D8/22 |
| 4,425,828 | A | * | 1/1984 | Berdinner, Jr. | 81/57.39 |
| 4,479,409 | A | * | 10/1984 | Antonius | 81/58.3 |
| 4,570,513 | A | * | 2/1986 | Thompson | 81/125 |
| 4,594,922 | A | * | 6/1986 | Park et al. | 81/99 |
| 4,703,676 | A | * | 11/1987 | Mayer | 81/60 |
| 4,974,308 | A | * | 12/1990 | Nimberger | 29/469 |
| 5,010,626 | A | * | 4/1991 | Dominguez | 24/279 |
| D338,146 | S | * | 8/1993 | Gramera | D8/70 |
| D344,223 | S | * | 2/1994 | Kubicek | D8/25 |
| 5,297,458 | A | * | 3/1994 | Smith et al. | 81/124.2 |

(List continued on next page.)

FOREIGN PATENT DOCUMENTS

| | | | | |
|---|---|---|---|---|
| DE | 221 239 | * | 4/1910 | 81/125 |
| DE | 887 779 | * | 6/1954 | 81/125 |
| DE | 3212-954 A | * | 10/1983 | 81/125 |
| DE | 295 13 330 U 1 | * | 2/1997 | |
| DE | 197 36 933 C 1 | * | 10/1998 | |

*Primary Examiner*—Allan N. Shoap
*Assistant Examiner*—Jason Prone
(74) *Attorney, Agent, or Firm*—Sidley Austin Brown & Wood, LLP

(57) ABSTRACT

A tensioning device with a tensioning lever (1) and a detachable tensioning nut (2) has a pivotal tensioning cam (6), mounted elastically in the tensioning lever (1). The tensioning lever (1) has a seat (3) with a noncircular inside surface (4) for receiving the tensioning nut (2), which is mounted axially displaceably therein. The tensioning nut has an outside surface shaped to correspond to the noncircular surface of the seat (3). The tensioning nut (2) can be fixed removably in the tensioning lever (1) by a recess, which is disposed in the tensioning nut and into which the tensioning cam (6) can be engaged.

5 Claims, 2 Drawing Sheets

U.S. PATENT DOCUMENTS 5,333,522 A * 8/1994 Prather et al. ..... 81/64
5,535,647 A * 7/1996 Donaldson, Jr. ..... 81/426.5
D373,940 S * 9/1996 Kerlee et al. ..... D8/21
D387,640 S * 12/1997 Von Fange ..... D8/28
D390,764 S * 2/1998 Boyd et al. ..... D8/22
D394,789 S * 6/1998 Futo et al. ..... D8/21
6,189,421 B1 * 2/2001 Futo et al. ..... 81/3.44
6,220,124 B1 * 4/2001 Perkins ..... 81/155
6,435,063 B1 * 8/2002 Chen ..... 81/63.2

* cited by examiner

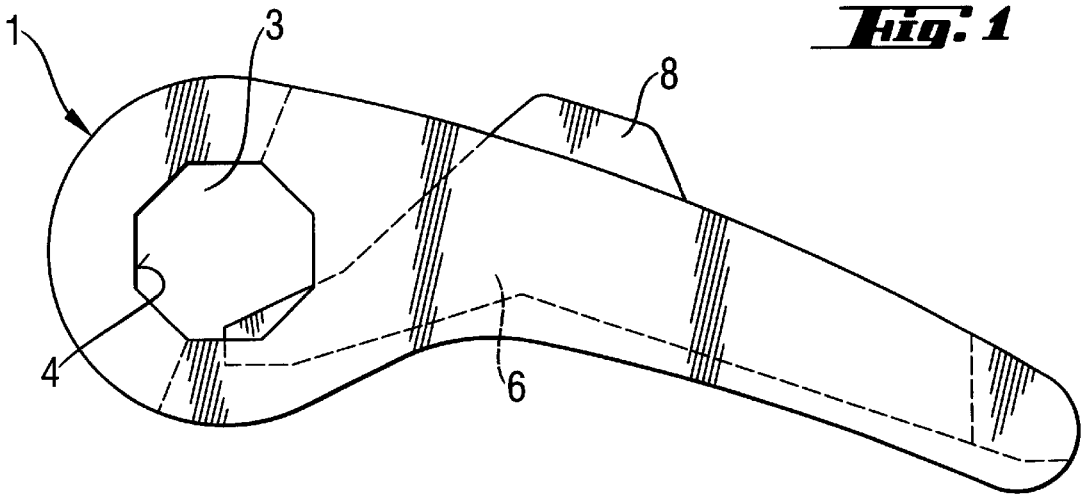
Fig. 1
Fig. 2
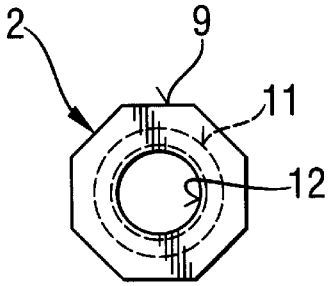
Fig. 3
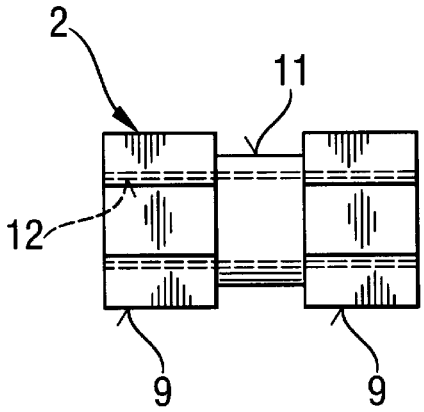

CLAMPING DEVICE FOR MANUALLY GUIDED ELECTRIC TOOLS

BACKGROUND OF THE INVENTION

The invention relates to a clamping device with a tensioning lever and a tensioning nut. The tensioning lever has a seat with a noncircular internal shape for receiving the tensioning nut, which is mounted axially displaceably in the seat and has a correspondingly shaped external contour.

Clamping devices of the type mentioned are used for the non-positive bracing of at least two parts, which can be moved relative to one another. By applying a torque to a tensioning nut by means of a tensioning lever, the clamping device exerts or releases a clamping effect, depending on the direction of action of the torque. For example, the tensioning nut may be screwed onto a bolt with an external thread. When a tensioning effect is exerted, the parts are pressed against one another and clamped by the thereby resulting frictional force. In the case of electric tools, especially in the case of manually guided circular saws, such clamping devices are used for fixing the angle of inclination between a stop plate and a working unit. In the absence of a clamping force, the angle of inclination can be adjusted and fixed in the desired position with the help of the clamping device. By these means, the user is enabled to carry out miter cuts or the like with the electric tool.

Such a clamping device is disclosed in the DE 197 36 933 A1. This known clamping device has a tensioning lever and a tensioning nut. The tensioning lever is provided with a seat with a noncircular internal shape for the tensioning nut, which is mounted axially displaceably therein. The external shape of the tensioning nut corresponds to the internal shape of the seat.

Through the use of a tensioning lever in the known clamping device, the user has at his disposal the lever action of the tensioning lever for exerting the clamping effect. With this, the user is enabled to act with a large torque on the screw connection, which is formed by the tensioning nut. It is a disadvantage of this known solution that the tensioning lever must always be taken along by the user.

Furthermore, in German patent 295/13/33 0, a clamping device with a tensioning lever and a screw connection is known. The screw connection has a screw, which is provided with a cross slot. Advantageously, the tensioning lever is fixed at the electric tool and therefore does not have to be carried along by the user. In addition, the clamping lever enables the clamping device to be operated without a tool.

It is a disadvantage of this known solution that the clamping device, mounted at poorly accessible places on the electric tool, makes complete bracing impossible. Furthermore, the tensioning lever may greatly impede the positioning of the electric tool in an exposed position.

SUMMARY OF THE INVENTION

It is an object of the present invention to create a clamping device for electric tools, which can be operated conveniently and safely by the user and, furthermore, can be manufactured economically.

Pursuant to the invention, this objective is accomplished owing to the fact that the tensioning lever has a tensioning cam, which can be disengaged against the force of a spring from the clear axial projection of the seat and, in the engaged state, is supported axially at the tensioning nut.

Due to the elastic tensioning cam, which can be disengaged, the tensioning lever can easily be removed from the tensioning nut. Furthermore, a user need not constantly carry along the tensioning lever and, instead, can leave it at the clamping device. If the tensioning lever is in an exposed position at the electric tool, the user can remove it and deposit it at the electric tool at a location intended for this purpose, loosen it and mount it once again at the position that is not exposed or take it along. Moreover, by repeatedly tightening and putting into place the removable tension lever, the user can brace the clamping device even in tight space conditions for the tensioning lever. The noncircular shape of the seat, together with the external shape of the tensioning nut, brings about a positive connection and thus enables the torque acting on the tensioning lever to be transferred. Instead of the tensioning nut, it is, of course also possible to use a different screw connection. For example, a screw with an external shape, constructed to correspond with the internal shape of the seat, can be used.

Advantageously, in the engaged state, the tensioning cam is supported in a recess of the tensioning nut, in order to prevent axial movement of the tensioning nut relative to the tensioning lever in the engaged state. In contrast to a frictional connection, this positive connection, ensures a reliable, removable connection between the tensioning nut and the tensioning lever. In addition such a solution enables the clamping device to be manufactured economically.

The recess is constructed preferably as an annular groove extending over the periphery of the tensioning nut. By these means, it can be ensured that, in the engaged state of the tensioning cam, the latter engages the recess, especially the groove, independently of the torsional angle between the tensioning nut and the tensioning lever.

In a preferred embodiment, the end region of the tensioning cam, spaced from the seat, is hinged to the tensioning lever. For example, the connection in the end region may be brought about by an elastic material such as rubber or the like. A different possibility consists of connecting the end region of hinging to the tensioning cam by means of a bolt with the tensioning lever. In the case of such an arrangement, the spring force can be applied by a spring or a flexible tongue. In particular applications, the tensioning cam may, of course, also be hinged in a different region to the tensioning lever.

Advantageously, an end region of the tensioning cam is connected by material retention with the tensioning lever, in order to achieve the elastic property of the tensioning cam relative to the tensioning lever. However, in order to be able to use a solid material for the tensioning cam, this connection must be as far away as possible from the seat for the tensioning nut. If such a high stability is not absolutely essential in certain applications, the material retention connection between the tensioning cam and the tensioning lever may also be disposed closer to the seat.

The tensioning cam may also be separated partially from the tensioning lever by an air gap, in order to develop the least friction during a movement of the tensioning cam relative to the tensioning lever. However, when soft materials are used for the tensioning cam, friction may be undesirable or even obligatory for the functioning. In such arrangements, other materials may, of course, also be disposed between the tensioning lever and the tensioning cam.

Preferably, the tensioning lever and the tensioning cam are formed from a plastics material. An economic manufacture of the tensioning device is assured with this distinguishing feature.

BRIEF DESCRIPTION OF THE DRAWING

The invention is explained in greater detail below by means of a preferred embodiment shown in the drawing as follows:

FIG. 1 is a side view of a tensioning lever of an inventive clamping device;

FIG. 2 is a front-end view of a tensioning nut of the inventive clamping device;

FIG. 3 is a side view of the tensioning nut illustrated in FIG. 2,

DETAILED DESCRIPTION OF THE INVENTION

FIGS. 1 to 5 show an inventive clamping device with a tensioning lever 1, and a tensioning nut 2.

Figure 4:
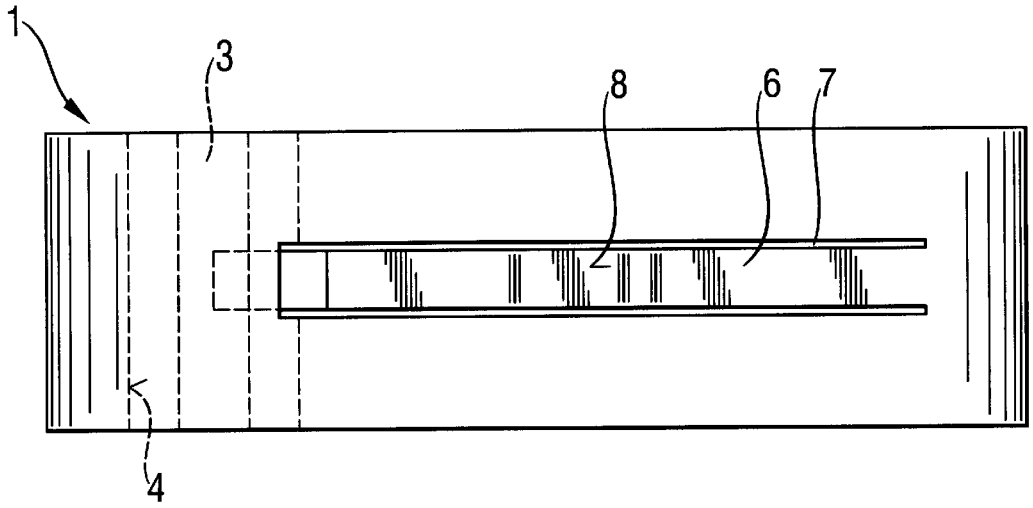
FIG. 4 is a plan view of the tensioning lever illustrated in FIG. 1.
Figure 5:
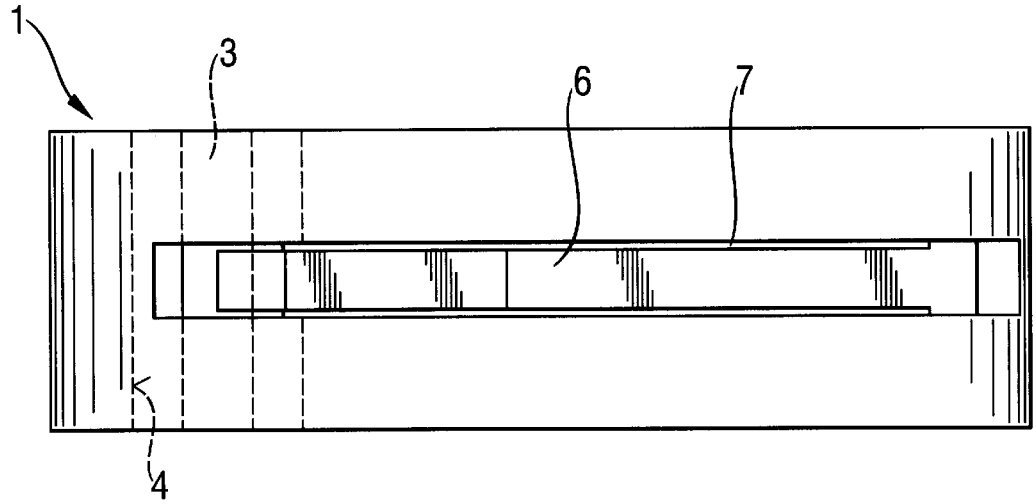
FIG. 5 is a bottom view of the tensioning lever, illustrated in FIG. 1.

The tensioning lever 1, which is shown particularly in FIGS. 1, 4 and 5, is elongated and has an axial extending seat 3 transversely of its elongated direction with a non-circular, particularly polygonal internal shape 4. The opposite end region of the lever, that is the right end in FIG. 1 is formed as a handle. An elastically constructed tensioning cam 6 is arranged in the tensioning lever 1 and extends into the clear axial projection of the seat.

The tensioning cam 6 is disposed in the axial range of the seat 3 approximately centrally between the elongated sides of the tensioning lever 1, being connected by retention of material with the lever at the opposite end from the seat 3. In the remaining region between the connection of the tensioning cam 6 and the tensioning lever 1, surrounding the tensioning cam 6, is an air gap 7 extending in the elongated direction of the lever up to the seat 3. The elastic property of the tension cam 6 arises from the fact that the tensioning lever 1 and, above all, the tensioning cam 6 are formed from plastics or another elastic material. For disengaging the tensioning cam 6 from the axially projection of the seat 3, the tensioning cam has a compression projection 8, which protrudes outwardly from the upper side of the tensioning lever 1 as viewed in FIG. 1.

The tensioning nut 2 of the inventive tensioning device, with an external shape 9, is formed to correspond to the internal shape 4, and an internal thread 12 is shown particularly in FIGS. 2 and 3. Accordingly, a torque applied to the tensioning lever 1 is transferred by the positive connection between the tensioning nut 2 and the tensioning lever 1 to the clamping device. At its periphery, the tensioning nut 2 has a annular recess or groove 11, into which the tensioning cam 6 can be brought. The recess is located between the two polygonally shaped ends of the tensioning nut 2.

In the set state, the tensioning nut 2 lies in the seat 3 in such a manner, that the tensioning cam 6 engages the recess 11. By these means, the axial movement of the tensioning nut 2 relative to the tensioning cam 6 is limited by the axial width of the recess 11, which preferably corresponds approximately to the wall thickness of the tensioning cam 6, that is transverse to the elongated direction of the tensioning lever. For disengaging the positive connection between the tensioning lever and the tensioning nut 2, the compression projection 8 is acted upon with an external force towards the tensioning lever 1, as a result of which the tensioning cam 6 is displaced out of the axial projection of the seat 3 that is, out of the recess. Accordingly, the tensioning nut 2 can be moved relative to the tensioning lever 1 and out of the seat 3. The symmetrically arranged internal shape 4 enables the tensioning nut 2 to be positioned once again in a position turned relative to the tensioning lever 1. This is advantageous particularly when the displacement angle for bracing the tensioning device is limited.

What is claimed is:

1. A clamping device comprises an elongated tensioning lever (1) having a first end and an opposite second end with a seat extending through said tensioning lever having an axis located adjacent the first end of said tensioning lever and extending transversely of the elongated direction of said tensioning lever and a tensioning nut (2) removably engageable in said seat in said tensioning lever (1), said seat (3) has a noncircular surface encircling the axis thereof, said tensioning nut (2) in said seat has an axis extending generally parallel to the axis of said seat and has an outside surface corresponding at least in part to the noncircular surface of said seat, said tensioning lever (1) has a tensioning cam (6) extending in the elongated direction of said tensioning lever (1) and displaceable relative to said tensioning lever between a first position within said seat (3) and a second position out of the said seat (3), said tensioning lever (1) and said tensioning cam (6) each being formed of a same elastic material and said tensioning cam is maintained in the first position by a spring action of said elastic material and is disengaged into the second position by an effort exercised counter to the spring action, said tensioning cam (6) having a first end and a second end spaced apart in the elongated direction of said tensioning lever with the second end of said tensioning cam (6) formed in one piece with said tensioning lever (1) by material retention for displacement between the first and second positions thereof, and said tensioning cam having opposite sides extending between the first and second ends thereof and at the first end thereof and along said opposite sides being spaced from said tensioning lever for affording the displacement between said first and second positions, in the first position within said seat (3) said tensioning nut (2) and said tensioning cam (6) form a positive connection in the axial direction of said tensioning nut (3).

2. A clamping device, as set forth in claim 1, wherein said tensioning cam (6) in the first position is supported at a wall of an axially extending recess (11) in an outer surface of said tensioning nut (2).

3. A clamping device, as set for in claim 2, wherein said tensioning lever (1) and said tensioning cam (6) are formed of a plastics material.

4. A clamping device, as set forth in claim 2, wherein said recess extends annularly around the axis of said tensioning nut (2).

5. A clamping device, as set forth in claim 2, wherein said tensioning nut (2) has a pair of axially extending polygonally shaped said noncircular surfaces spaced apart by said recess which is circularly shaped.

* * * * *